US006350082B1

(12) United States Patent
Rickards

(10) Patent No.: US 6,350,082 B1
(45) Date of Patent: Feb. 26, 2002

(54) METHOD FOR ASPHALT COMPACTION AND COMPACTION APPARATUS

(75) Inventor: Ian James Rickards, Eltham (AU)

(73) Assignee: Pioneer Road Services PTY Ltd., Melbourne (AU)

( * ) Notice: Subject to any disclaimer, the term of this patent is extended or adjusted under 35 U.S.C. 154(b) by 0 days.

(21) Appl. No.: 09/269,003

(22) PCT Filed: Sep. 18, 1997

(86) PCT No.: PCT/AU97/00613

§ 371 Date: Jun. 14, 1999

§ 102(e) Date: Jun. 14, 1999

(87) PCT Pub. No.: WO98/12386

PCT Pub. Date: Mar. 26, 1998

(30) Foreign Application Priority Data

Sep. 18, 1996 (AU) ..... PO 241 4

(51) Int. Cl.[7] ..... E01C 7/06; E01C 19/26
(52) U.S. Cl. ..... 404/75; 404/122; 404/124
(58) Field of Search ..... 404/75, 77, 79, 404/95, 122, 124, 128, 84.05

(56) References Cited

U.S. PATENT DOCUMENTS

| | | | | | |
|---|---|---|---|---|---|
| 1,952,398 | A | * | 3/1934 | Tullis | 404/118 |
| 3,009,401 | A | | 11/1961 | Greiner | |
| 3,473,619 | A | * | 10/1969 | Dion | |
| 3,696,878 | A | * | 10/1972 | Nelson | 180/9.46 |
| 4,124,325 | A | * | 11/1978 | Cutler | 404/75 |
| 4,175,885 | A | * | 11/1979 | Jeppson | 404/77 |
| 4,226,552 | A | * | 10/1980 | Moench | 404/92 |
| 4,647,247 | A | * | 3/1987 | Sandstrom | 404/75 |
| 4,661,011 | A | | 4/1987 | Halim | 404/124 |
| 4,737,050 | A | | 4/1988 | Halim | |
| 4,818,139 | A | * | 4/1989 | Brock et al. | 404/81 |
| 4,966,242 | A | * | 10/1990 | Baillargeon | 180/9.44 |
| 5,417,516 | A | * | 5/1995 | Birtchet | 404/71 |
| 5,480,259 | A | * | 1/1996 | Thrower | 404/117 |
| 5,899,630 | A | * | 5/1999 | Brock | 404/79 |
| 5,921,708 | A | * | 7/1999 | Grundl et al. | 404/84.1 |

FOREIGN PATENT DOCUMENTS

| | | |
|---|---|---|
| AU | 61170/73 | 4/1975 |
| EP | 200949 A | 11/1986 |
| WO | WO 87/07921 A | 12/1987 |

OTHER PUBLICATIONS

Halim, Omar Abd El et al, "Improving the Properties of Asphalt Pavement Through the Use of AMIR Compactor: Laboratory and Field Verification," 7th International Conference on Asphalt Pavements, Nottingham, 1992.

* cited by examiner

*Primary Examiner*—Gary S. Hartmann
(74) *Attorney, Agent, or Firm*—Seed Intellectual Property Law Group PLLC

(57) ABSTRACT

A method of compacting a mat of hot mix asphalt which has been laid by an advancing asphalt paver, the method comprising advancing an asphalt compactor over the laid asphalt such that a compaction surface of the compactor, formed by a lower run of at least one belt, is engaged with any one portion of the mat for a period of at least 1.5 seconds, the compaction surface applying a maximum average load stress to the mat of less than about 50 kPa. Compaction may be achieved using a compactor comprising two longitudinally spaced modular compaction units connected relative to each other, and a power source for driving at least one of the modular compaction units, wherein at least one of the modular compaction units is adjustable to permit steering of the compactor, and wherein each of said modular compaction units comprises a compaction belt, support means for the belt to define a planar lower run of the belt forming a compaction surface.

13 Claims, 4 Drawing Sheets

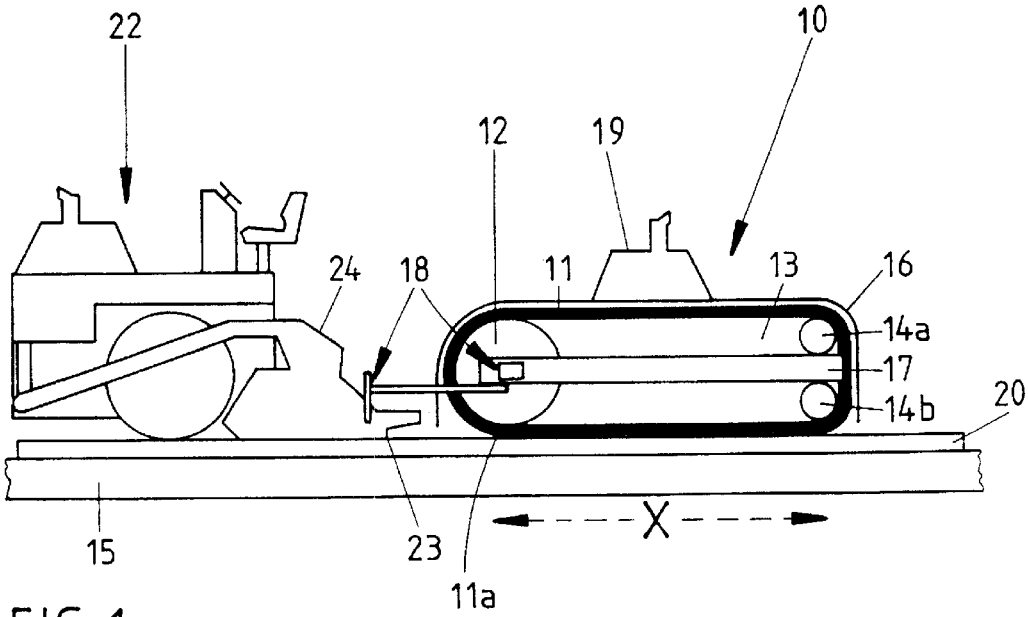
FIG 1
FIG 2
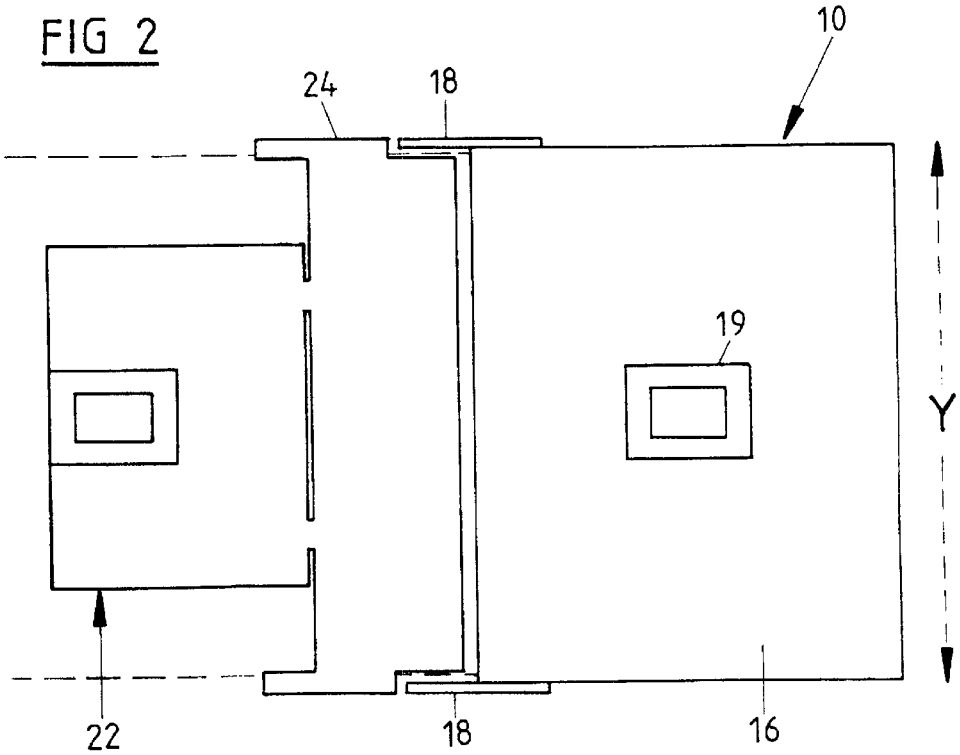

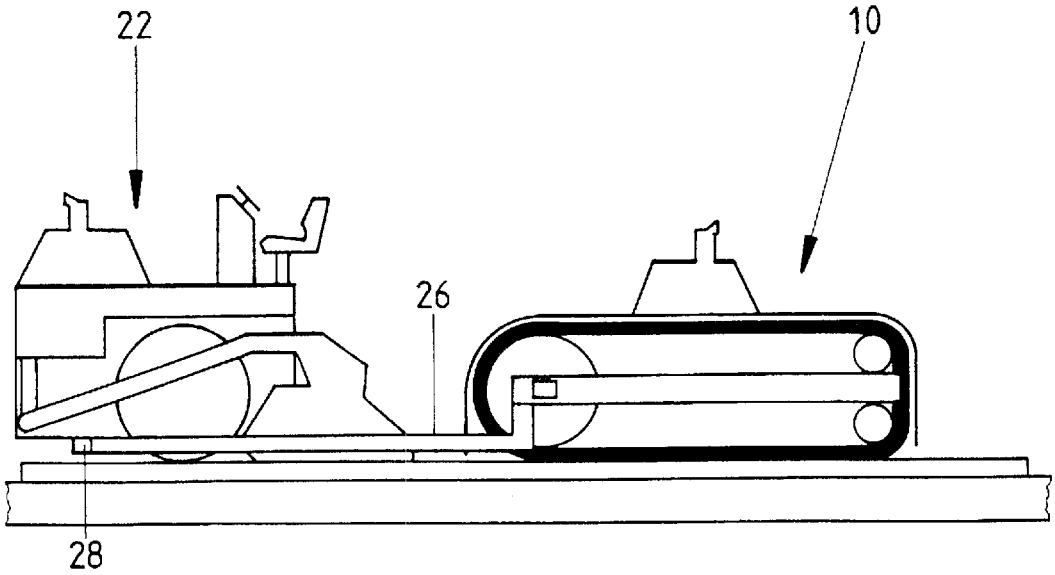
FIG 3
FIG 4
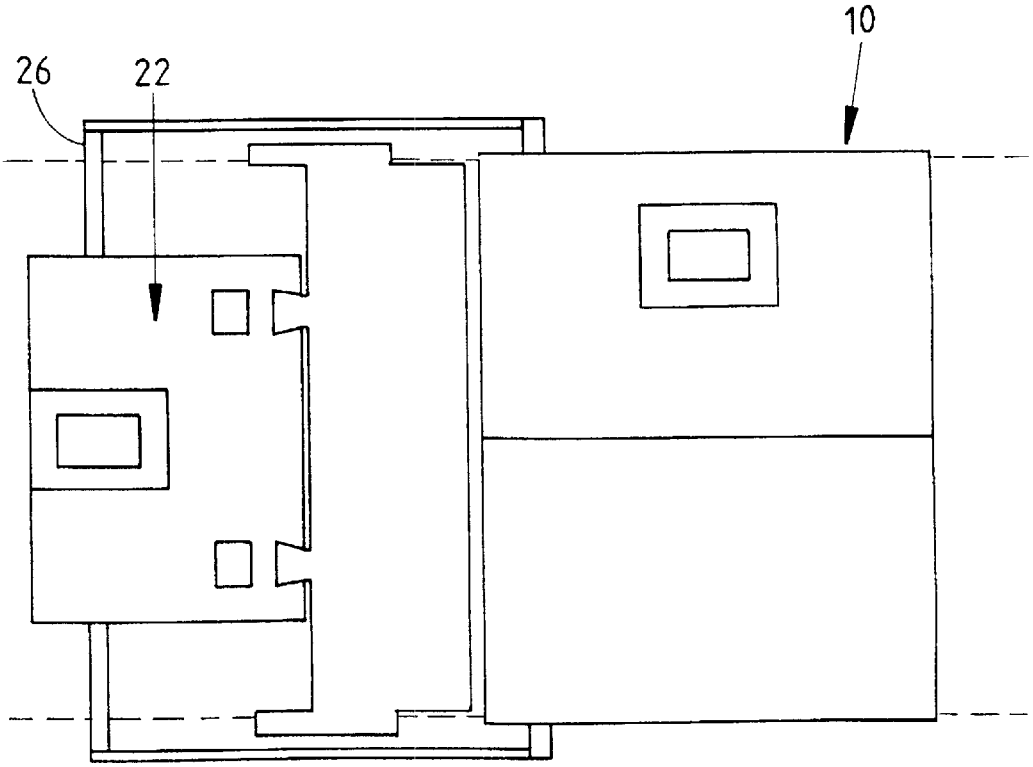

METHOD FOR ASPHALT COMPACTION AND COMPACTION APPARATUS

This application is a 371 of PCT/AU97/00613, filed Sep. 18, 1997, now WO 98/12386.

TECHNICAL FIELD

The present invention relates to a method for the compaction of asphalt and a compaction apparatus. More particularly, the present invention relates to a method and apparatus for compacting hot mix asphalt under conditions which advantageously optimise binder flow within the asphalt during compaction.

By the term "binder" as used throughout this specification is meant any thermoplastic visco-elastic material which may be used in hot mix asphalts. Generally the binder will be bitumen or bituminous, that is a bitumen incorporating, for example polymeric modifiers. It is also known for hot mix asphalt to incorporate polymer binders with no bitumen based binders present, and the present invention extends to the compaction of all such hot mix asphalts.

BACKGROUND OF THE INVENTION

Inherent in modern asphalt mix design for heavy duty applications is the use of components (aggregates and binders) which are purposely selected to resist compaction and loss of shape under heavy traffic. These properties will generally hinder the achievement of the desired compaction during laying of the asphalt.

The principal asphalt mix design element to resist compaction under heavy traffic is the use of aggregates with extremely rugose texture and cuboid shape, aimed at providing high shear resistance within the aggregate skeleton. In simple terms the objective is to ensure the physical properties of the aggregate inhibit particle movement and promote "lock up" in the structure under the applied load stress in operation. Stiffer binders such as polymer modified binders are increasingly being used to augment both the shear strength of the mix and also to improve the flexural or fatigue properties of the mix.

The achievement of lock up of the aggregate and the distribution of air voids in the mix on compaction and during laying determines asphalt durability and overall performance over the entire range of pavement loadings. Lock up of aggregate is advantageously achieved by displacing the aggregate within the binder during compaction of the asphalt mat.

The properties of the asphalt mix are also determined by the visco-elastic properties of its binder. At ambient service temperatures the binder desirably acts as a stiff elastic solid; the response to load in the asphalt mix is very nearly elastic and a rapid load pulse will result in a virtually instant elastic deformation which will recover almost the instant the load is removed. Thus, there is substantially no viscous flow and resultant permanent plastic strain. At the higher temperatures at which asphalt is laid and compacted, the binder in the mix is a visco-elastic fluid. The higher the temperature, the lower the viscosity of the binder and the more readily the binder will deform under any applied stress.

The compaction process begins with the laydown of hot asphalt by a paver on a prepared base, usually followed by pressure on the hot asphalt mat applied by a screed (with or without vibration). The screed is a plate or skid carried by the paver which slides over the surface of the asphalt mat desirably at or close to the temperature at which the mat is laid. The screed applies some initial compaction, but by its sliding action may undesirably cause shear stress in the mat leading to tearing of the mat. Typically the applied static screed pressure is in the order of 10 to 20 kPa and the load duration may be as long as 10–15 seconds.

Conventionally, asphalt compaction has been carried out using equipment originally intended for compacting granular non-cohesive materials designed to maximise the compaction energy applied to the material, primarily by using large and heavy steel drum rollers, often in combination with high energy oscillation or vibration. Rubber-tired roller compaction is often used in conjunction with steel drum roller compaction, as described hereinafter.

The contact stress between the roller and the asphalt mat generally depends on the stiffness of the asphalt mix which is in turn strongly influenced by the stiffness of the binder. The contact area between the steel drum and the asphalt, that is the length of contact by the width of the roller drum, will diminish as a result of the compaction achievement and the increase in mix stiffness with the cooling of the mat. Typically the mix is at a temperature of about 150° C. when it is laid. In low temperature environments under adverse conditions such as when a strong wind is blowing, it is quite feasible the mix will cool to say 140° C. at the bottom of the layer and 120° C. at the surface before the first compaction pass.

The largest dual steel drum vibratory roller compactor presently in general use has a static mass of about 16 tonne with each drum having an axial length of about 2 m. Assuming a nominal 100 mm contact length in the roller direction (more in the initial pass, less in the final pass), each drum will apply a contact stress of about 400 kPa static and considerably more with vibration. In fact, each drum may apply a contact stress from about 100 kPa in a first static breakdown pass to well over 1000 kPa as the asphalt mix stiffness and the contact area reduces. Compaction by the roller compactor usually occurs at varying distances, up to several hundred meters, behind the paver and at speeds of about 1.1 m/s (4 km/h) or more. The two drums of the roller compactor each having the above nominal contact length of 100 mm and therefore the roller will typically be in contact with any part of the asphalt mat for about 0.2 seconds in each pass. Typically, about four steel roller passes are used, giving a total load time of about 0.8 seconds.

The roller compactor typically vibrates at about 20 Hz, which at temperatures of 140° C. and 120° C. corresponds to relatively high binder stiffness (shown by Van der Poel's nomograph) of about 0.2 kPa and 1 kPa respectively (each 20° C. reduction in temperature has about a 5 fold increase in bitumen stiffness).

As described above, the surface temperature of the mat may fall to temperatures of about 120° C. before the roller compaction process is begun. The compaction process may typically include up to 4 roller compactor passes, by which time the mat surface temperature may be in the range 80–90° C. At mat temperatures below about 120° C. cracking of the mat may be initiated in the mat at high contact stresses, particularly at stresses induced using vibration. Mat cracking typically occurs when the applied stress induces strain in the binder in excess of its yield strength. At temperatures considerably above 120° C. conventional roller compaction may lead to significant shear failure in the mat, depending on the asphalt mix type. This may result in the mat being displaced laterally with loss of level and shape and ultimately in de-compaction of the mat.

Roller cracking resulting from low mat temperatures is usually manifest as fine, parallel cracks in the asphalt mat which are transverse to the direction of rolling. A multi-wheeled rubber-tired roller following the vibratory roller compactor is commonly used to apply a kneading/shearing action to at least the surface of the compacted asphalt mat, and thereby complete the compaction of the mat. Such rubber-tired rolling is thought to close steel roller-induced cracks, at least at the surface of the asphalt mat, and increases surface texture by compressing the asphalt mortar between any coarse aggregate particles. Water is applied to the tires of the rubber-tired roller during rolling to alleviate material pick-up. However, although the cracks may be closed at the surface this water may inadvertently be injected into the cracks before they are sealed, forming encapsulated water deposits beneath the surface of the asphalt mat. Encapsulated water may inhibit healing or encourage stripping in the asphalt mat.

U.S. Pat. Nos. 4,661,011 and 4,737,050 claim to alleviate roller-induced cracking in the asphalt mat by use of an asphalt compaction machine in which pressure is applied to the asphalt mat through an endless elastomeric belt extending between two rollers. The machine is configured to apply a more uniform pressure over the area of the belt in contact with the asphalt mat.

It has now been recognized in accordance with the present invention that in a visco-elastic fluid, such as the binder in a hot mix asphalt, the response to load is not only temperature dependent but also time dependent. Thus, the application of a load of short duration will result in an asphalt response which is more elastic than viscous as the binder simply does not have time to flow. Therefore, using a vibratory roller compactor at an accepted loading rate in the order of 20 Hz, the binder in the asphalt mix reacts during compaction more as an elastic solid than as a viscous fluid and the compaction attempts to force the aggregate through the binder into a more compact arrangement, rather than causing the binder to flow around the aggregate with consequent movement of the aggregate.

The previously mentioned Van der Poel nomograph provides an estimate of the stiffness of standard bitumen grades at selected rates of load application and temperature. Even though the nomograph is well known to those skilled in the art of asphalt compaction, the disadvantages of applying compaction loads of short duration have not previously been fully recognized and short duration compaction using rollers with both steel and rubber interfaces, with or without vibration, has continued to be the accepted practice.

It may now be recognized that by using the belt compactor of the aforementioned US Patents, improved compaction can be achieved by inducing viscous flow of the binder. Test uses of the belt compactor are described, for example, by Halim OAE et al in "Improving the Properties of Asphalt Pavement Through the Use of AMIR Compactor: Laboratory and Field Verification", 7th International Conference on Asphalt Pavements, Nottingham, 1992. However, no recognition is given to the advantages of longer load times.

The described belt compactor may apply a load stress of only about 5% of the aforementioned 16 tonne roller compactor under static load, but assuming conventional advancement rates are used the load may be applied over a longer duration than a roller compactor due to the increased contact length of the belt. For a contact length of 1.25 m as described in the aforementioned paper and a typical compaction speed of about 1.1 m/s, the load duration will be about 1.1 secs. Using Van der Poel's nomograph, this increased load duration can be shown to reduce the binder stiffness at 120° C. from about 1000 Pa for the aforementioned conventional vibrating roller compaction to about 5 Pa for the belt compactor.

SUMMARY OF THE INVENTION

According to one aspect of the present invention there is provided a method of compacting a mat of hot mix asphalt which has been laid by an advancing asphalt paver, the method comprising advancing an asphalt compactor over the laid asphalt such that a compaction surface of the compactor, formed by a lower run of at least one belt, is engaged with any one portion of the mat for a period of at least 1.5 seconds, the compaction surface applying a maximum average load stress to the mat of less than about 50 kPa.

Without wishing to be bound by theory, it is believed that the present invention maximises the strength of the asphalt following compaction by employing the visco-elastic behaviour of the binder during compaction, that is reducing the binder stiffness, allowing the binder time to flow away from aggregate particle contacts while using the applied stress to reorientate the aggregate particles within the visco-elastic binder in order to optimise intimate contact of the aggregate particles without the application of high stress. On the other hand, the conventional steel roller compaction process described above focuses on the aggregate components, using strong force to overcome the resistance to flow of the binder and stress transfer from aggregate particle to particle to improve the intimate contact between the particles.

The principal variables which can be used to reduce the stiffness of the binder in the design asphalt mix are:

1. Asphalt Temperature:
   using Van der Poel's nomograph, it is clear that increasing the temperature of the asphalt at compaction by about 10° C. more than halves the binder stiffness; and
2. Load Duration:
   again using Van der Poel's nomograph it may be seen that, for example, a 10% increase in the duration that the compactor applies the load reduces the binder stiffness by about 10%. Load duration may be varied by changing either or both the length of the compaction surface and the rate of displacement of the compactor over the mat.

In a first embodiment the method comprises advancing the asphalt compactor over the laid asphalt substantially at the rate of advancement of the asphalt paver and within about 50 m behind the asphalt paver.

As may be readily seen from the above, the temperature of compaction is the first key element in reducing the stiffness of the selected binder. Asphalt is generally manufactured at a temperature of about 160° C. and laid at a temperature of about 150° C. By advancing the compactor immediately behind the paver, that is with compaction being initiated within about 50 m of the paver, in accordance with the above embodiment of the invention, the compaction method exploits the heat energy supplied in the asphalt manufacturing process.

By exploiting the low maximum average applied load stress with at least substantially no shear stress, the method may advantageously be performed at higher mat temperatures than conventionally used, for example up to 160° C. Equally, the method of the invention may enable the asphalt to be compacted at temperatures below the normal compaction temperature. This may advantageously allow the asphalt to be manufactured at a lower temperature than is conventionally used, with consequential energy savings.

Advantageously, the compactor is advanced substantially at the rate of the paver within about 30 m, preferably within about 10 m, behind the paver. In a preferred embodiment of the first aspect of the invention the asphalt compactor is advanced over the asphalt mat within about 5 m behind the advancing asphalt paver and most preferably within about 2 m behind the asphalt paver.

In this preferred embodiment, the compactor may be advanced by the paver, that is the compactor may be connected to the paver. However, advantageously, the compactor belt is driven in order to minimise "shoving" of the asphalt being compacted. The drive is advantageously an auxiliary hydraulic drive. When the compactor is not connected to the paver, the distance between the two, and therefore the speed and direction of the compactor may advantageously be controlled automatically via relative location sensor means.

As discussed above, a second key element in the compaction process is load duration. Assuming a typical asphalt placement rate of 1000 tonne per 6 hour day per paver, laying asphalt in a 50 mm thick layer, a paver may travel at about 0.1 m/s. Higher paving rates, up to about 0.15 m/s, are known but not commonly adopted, and lower rates of 0.05 m/s or less may be used especially for thicker layers of asphalt.

Even advancing at the above maximum paving rate of about 0.15 m/s in the method of the above embodiment of the invention, the compaction surface of the compactor belt is preferably engaged with any one portion of the asphalt mat for a period of at least about 7 seconds, ensuring a reduced binder stiffness during compaction.

While the advantages of elevated temperature of the asphalt mat are best achieved if the compactor follows immediately behind the asphalt paver, many advantages will still be achieved if the distance between the paver and compactor is increased. Particularly on small jobs, the rate of advancement of the compactor and therefore the distance of the compactor from the paver may be independent of the paver and still achieve the aim of the invention of reducing the binder stiffness during compaction by virtue of a longer load duration than has been adopted conventionally.

Thus, according to a second embodiment of the invention the method comprises compacting the asphalt with the compactor by advancing the compactor over the mat at a rate of no more than about 0.7 m/s.

By this embodiment of the present invention, taking the maximum displacement rate of about 0.7 m/s it will be understood that the minimum length of the compaction surface is about 1 m. This will result in the compaction surface being engaged with any one portion of the asphalt mat for the minimum period of at least about 1.5 seconds, in any one pass. This represents about a seven-fold increase over the traditional roller compaction described above giving an even greater reduction in binder stiffness at the same compaction temperature.

Preferably the total compaction duration in the method of either embodiment described above is in the range from about 7 seconds to about 60 seconds, more preferably at least 10 seconds and most preferably at least 15 seconds. This compaction duration may be achieved in a single pass, although the load stress may be applied in two or more separate passes by, for example two or more separate successive compactor surfaces which closely follow one another. Preferably, the load is applied in two or more separate passes, any one portion of the mat being engaged by a compaction surface for a period of at least about 1.5 seconds on each pass.

As noted above, the compaction duration may be varied by changing the speed of compaction and/or the length of the compaction surface. Additionally, particularly in the method of the second embodiment of the invention described above, the number of times the compactor is displaced over the mat surface may be varied. The rate of compaction in the method of the second embodiment of the invention preferably is in a range from about 0.6 m/s to about 0.05 m/s or less, that is conventional paving speeds, more preferably from about 0.5 m/s to about 0.1 m/s.

The length of the compactor surface in either aspect of the invention is preferably about 1 m, more preferably at least about 1.5 m, and optionally may be about 2 to 3 m or more.

The maximum average applied load stress applied through the compaction surface is preferably less than about 40 kPa, more preferably less than about 25 kPa. However, the applied load stress may increase gradually from the leading edge of the compaction surface to the trailing edge, in which case the maximum line stress at the trailing edge of the compaction surface is preferably about 40 kPa and the maximum average applied load stress is about 25 kPa. The minimum average applied load stress is unlikely to be less than about 10 kPa. Such a low applied stress would only be suitable for, for example, an asphalt mix to be used in residential streets in which a greater proportion of visco-elastic binder may be used and the degree of lock-up of aggregate necessary for high traffic areas is not required.

Advantageously, as noted above the methods of the present invention may permit the asphalt mat to be compacted to the desired degree in a single pass, although variations in the compactability of the asphalt components, the depth of the asphalt mat and the substrate temperature may require adjustment of the asphalt mix temperature and load duration factors to achieve this. Correspondingly, the present invention may permit deeper layers of asphalt to be laid and compacted.

The belt in the compactor used in accordance with this aspect of the invention may be divided longitudinally to form two parallel tracks to which varying drive may be applied to facilitate turning of the compactor. With an elastomeric belt, different stresses may be applied to opposite sides of the belt to facilitate turning. Alternatively, a single belt compactor may be steered by the aforementioned connection with the paver or by a steerable tractor unit behind the compactor. Such a tractor unit may be of a type well known for use with existing compactors and may include track, tire or roller drive which may be adapted to provide additional compaction to and/or surface texture of the asphalt. Alternatively, again, the compactor may conveniently include two longitudinally spaced belts, with the compactor being hinged between the belts to facilitate turning. By the method of the present invention the compaction surface of the belt may engage the mat surface without substantial relative sliding movement in the displacement direction therebetween because the or each belt rotates at the displacement rate of the compactor over the asphalt mat. It will be appreciated that there will be a small degree of relative sliding movement at least partly in a lateral direction when the compactor is turned, but this degree of relative sliding movement will usually be sufficiently small in use of the compactor as to not be substantially detrimental to the compaction of the asphalt. In preferred compaction procedures in the method according to the second embodiment of the invention, any turning of the compactor to reverse the direction of compaction is performed on previously compacted mat.

According to another aspect of the invention there is provided a compactor comprising two longitudinally spaced support assemblies connected relative to each other, at least one of the support assemblies being adjustable to permit steering of the compactor, and a power source for driving at least one of the support assemblies, and wherein at least one of the support assemblies comprises a modular compaction unit including a compaction belt, support means for the belt to define a planar lower run of the belt forming a compaction surface.

According to a further aspect of the invention there is provided a compactor comprising at least two longitudinally spaced modular compaction units connected relative to each other and a power source for driving at least one of the modular compaction units, wherein at least one of the modular compaction units is adjustable to permit steering of the compactor, and wherein each of said modular compaction units comprises a compaction belt and support means for the belt to define a planar lower run of the belt forming a compaction surface.

The compactor according to these aspects of the invention is particularly suitable for use on a hot mix asphalt mat, but may also be useful in the compaction of other paving materials.

Where only one of the support assemblies comprises a modular compaction unit, the other support assembly relative to which it is connected may be, for example, an asphalt spreader in which case it may be used in accordance with the method of the first aspect of the invention, or a steerable tractor unit in which case the compactor may be used in accordance with either of the methods of the first and second aspects of the invention. In these embodiments, the modular compaction unit is preferably, but not necessarily, pivotally connected by a hitch relative to the other support assembly.

Alternatively, in accordance with the abovementioned aspect both of the support assemblies comprise modular compaction units each including a compaction belt, support means for the belt to define a planar lower run of the belt forming compaction surface. The units may be attached, for example, by a hitch at one end of one unit pivotally connected relative to the other unit. In this embodiment, the two modular compaction units are preferably pivoted relative to each other, for example by hydraulic means, to turn the compactor. In this arrangement, the two modular compaction units advantageously replace two steel drum modules in any known articulated dual drum roller compactor.

Alternatively, again, the other support assembly may comprise, for example, two belt compactors connected side-by-side, optionally in a spaced apart manner with the one modular compaction unit adapted to compact the portion of the mat between the spaced belt compactors. The modular compaction unit and the two spaced belt compactors may be pivoted relative to each other, for example by hydraulic means, to turn the compactor. This arrangement may advantageously increase the width of compaction in a single pass.

It will be appreciated that when the compactor in accordance with this aspect of the invention comprises a single modular compaction unit and the aforementioned steerable tractor unit or two side-by-side belt compactors, or two relatively pivoted modular compaction units, the compactor is preferably, but need not be, used in accordance with the method of either of the first and second aspects of the invention.

Preferably the modular compaction unit or at least one of the modular compaction units is driven, that is rotation of its belt is powered.

Most advantageously, the or each modular compaction unit in a compactor in accordance with these aspects of the invention is designed to replace the or each drum assembly in a conventional roller compactor.

The belt lower run in the or each modular compaction unit is advantageously at least 1 m long, and may be as long as 2 or 3 m or more. The belt in any aspect of the invention may be supported for rotation on the compactor by any suitable means. For example, in one embodiment the belt extends between two or more drums or rollers, such as two large diameter drums or a single larger diameter drum at the leading end of the compactor, which is preferably driven to alleviate shoving as described already, and two smaller drums or rollers respectively defining the upper and lower runs of the belt at the trailing end of the compactor. In another embodiment, the lower run of the belt extends between two relatively small drums or rollers and at least one upper roller, which may be larger, supports the upper run of the belt. Between the leading and trailing ends of the lower run, the belt may also be supported or engaged by any suitable means to provide the desired constant or gradually increasing load stress to the surface. For example, the aforementioned steel-segment belt may be supported by spaced rails or other guide means, while the aforementioned elastomeric belt may be supported by an array of intermediate rollers or drums or by a slide surface.

The width of the belt in the compactor used in the first aspect of the invention is advantageously substantially the same as that of the spreader of the paver, for example 4 m, but may be less. For example, for smaller projects requiring manoeuvrability of the compactor it may be convenient to have a smaller belt width such as approximately half the spreader width or less. Correspondingly, the belt width may in some circumstances advantageously be smaller than that of the spreader, for example 2 m or less.

The belt in any aspect of the invention may be formed of any suitable material taking into account the specific requirements of any particular application of the compactor. Thus, the belt may comprise elastomeric material such as laminated rubber, for example as described in the aforementioned US patent specifications. Alternatively, the belt may comprise a series of pivotally interconnected rigid segments or, for example, be formed of mesh or woven wire. Such segments, mesh or wire may be formed of steel or other suitable material. Any such non-elastomeric belt may have elastomeric pads secured to the outer surface thereof to contact the material surface.

Using an elastomeric belt or a belt having elastomeric pads secured thereto on a hot mix asphalt will generally provide a better surface texture to the compacted asphalt than using a non-elastomeric belt alone due to compression by the elastomeric material of bitumen around coarse aggregate fractions at the surface of the asphalt. However, when a non-elastomeric belt is used alone, a similar effect may be achieved by subsequently rolling the surface with a rubber tired roller.

In order to alleviate heat loss from, for example, a hot mix asphalt during compaction, except for its lower run the compactor belt in any aspect is advantageously enclosed within the compactor. The enclosure may be formed in part or wholly by an insulating shroud and advantageously extends over the belt at least substantially to the level of the compaction surface. Such a shroud may be formed in one or more parts, for example from reinforced plastics such as fiberglass or a metal such as aluminium or steel with or without an insulating mat. The belt may be partly enclosed by a support system for the belt.

In some circumstances, particularly but not only in methods where the compactor is not applied to the hot asphalt mat, it may be advantageous to heat the compactor belt. The compactor belt is preferably heated to at least the preferred temperature of the asphalt mat at compaction, for example about 120° C. to about 150° C. or more, and may heat the asphalt mat during compaction. The heating of the compactor belt may also ensure that the bitumen on the surface of the asphalt mat substantially does not adhere to the compactor belt.

The compactor belt may be heated by any suitable means, for example a super-heated air generator or direct flame heating such as propane flame heating. Such heating means may be remote controlled, for example by a infrared sensor aimed at the compactor.

BRIEF DESCRIPTION OF THE DRAWINGS

Alternatively, or in addition, the compactor advantageously includes one or more reservoirs for hot liquid adjacent the belt. The hot liquid may be, for example, heated oil or bitumen. The or each reservoir may include means for heating the liquid therein as well as means for introducing and draining the liquid from the reservoir.

A drum or roller associated with the compactor belt may act as a reservoir for the hot liquid. Alternatively, or in addition, a separate hot liquid reservoir may be provided between two such drums or rollers or adjacent a single such drum or roller.

Figure 5:
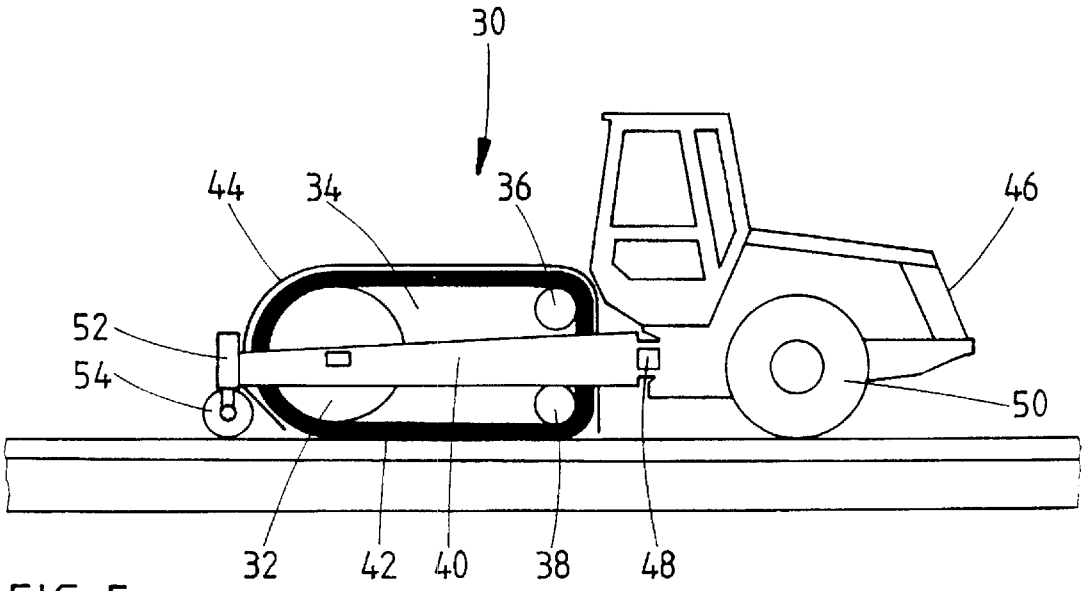
Figure 6:
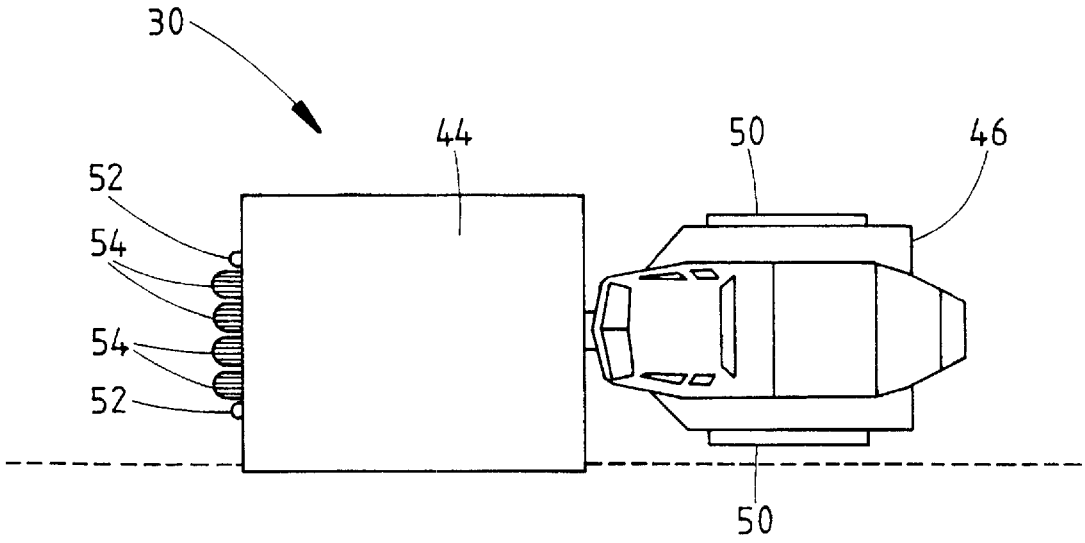
Figure 7:
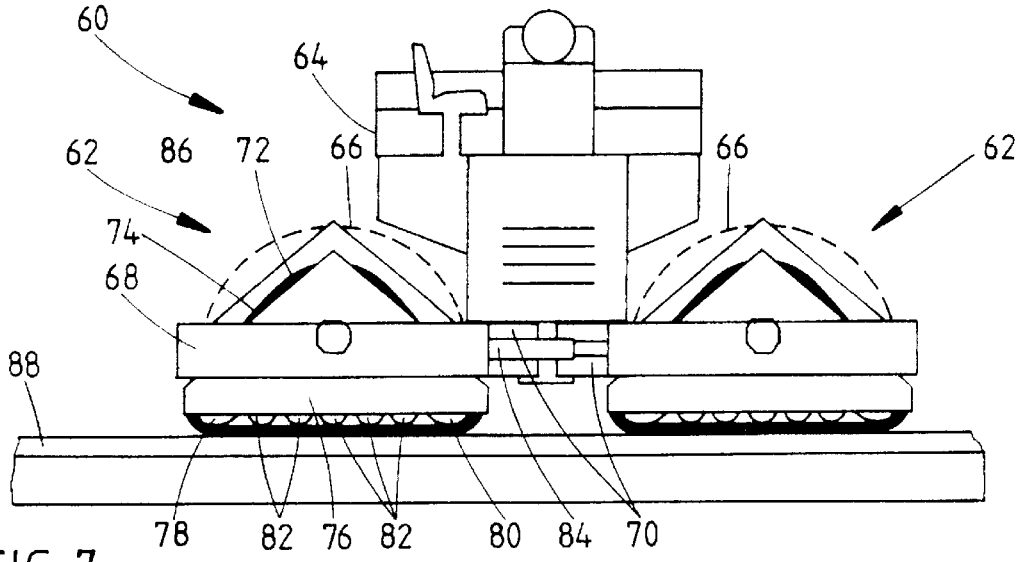
Figure 8:
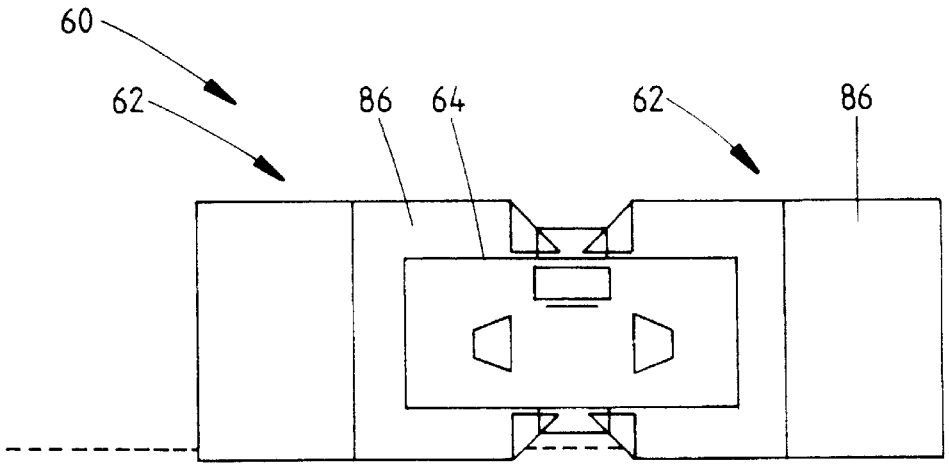

Various embodiments of methods and apparatus in accordance with one or more of the aspects of the invention will now be described, by way of example only, with reference to the accompanying drawings in which:

FIG. 1 is a side view of a paver and compacting apparatus working in tandem and maintained at a constant separation distance via relative location sensors;

FIG. 2 is a plan view of the paver and compacting apparatus illustrated in FIG. 1 and clearly depicting the relative location sensors;

FIGS. 3 and 4 correspond to FIGS. 1 and 2 but show a modification in which the paving and compaction apparatus are physically interconnected;

FIG. 5 is a side view of compacting apparatus attached to a conventional tractor from an articulated roller compactor;

FIG. 6 is a plan view of the compacting apparatus and tractor illustrated in FIG. 3; and FIGS. 7 and 8 show, respectively, a side elevational view and a plan view of self-powered compaction apparatus using two articulated modular compaction units.

DETAILED DESCRIPTION OF THE INVENTION

Referring to FIGS. 1 and 2, a compactor 10 compacts an asphalt mat 20 which has been laid by a spreader 24 of a paver 22 on a previously prepared base 15. The compactor 10 is a belt compactor and follows immediately behind the paver 22.

The compactor 10 includes a large diameter rotary drum 12 at a leading end adjacent the paver 22, an upper transverse roller 14*a* and a lower transverse roller 14*b* at a trailing end, and a hot liquid reservoir 13 disposed between the rotary drum 12 and the rollers 14*a* and 14*b*. The hot liquid reservoir 13 and the rotary drum 12 contain heated oil or bitumen at a temperature of about 150° C. The drum 12, rollers 14*a* and *b* and the reservoir 13 are all supported by a framework 17 depicted schematically by a single frame member.

A laminated elastomeric belt 11 extends around the rotary drum 12 and rollers 14*a* and 14*b*. The rotary drum 12 is driven by an auxiliary hydraulic drive 19 and, therefore, imparts rotation to the belt 11 and drive to the compactor. The belt 11, drum 12 and rollers 14*a* and 14*b* are split longitudinally with separate drives to the two halves of the drum 12 to provide steerage to the compactor. The elastomeric belt may advantageously be replaced by, for example, a steel belt having elastomeric pads secured thereto.

The lower run of the split belt 11 between the drum 12 and roller 14*b* is supported against upwards deflection at the level of the common tangent of the drum 12 and roller 14*b* by a slide surface defined by a bottom wall of the reservoir 13. Preferably, but not shown, an array of small rollers is provided beneath the reservoir 13 to support the belt in its planar lower run.

The compactor 10 also includes a thermal insulating shroud 16 which closely overlies the front, top and rear of the compactor and which thereby alleviates heat loss from those portions of the belt not in contact with the surface of the asphalt mat 20. The shroud 16 may also overlie the sides of the compactor 10 and thereby further alleviate heat loss from the drum 12 and reservoir 13, and therefore also from the asphalt.

The compactor 10 travels at a distance of from about 1 to 2 m behind the paver 22 at the speed of the paver. More particularly, the distance between an outer edge 23 of the spreader 24 for the asphalt and a leading edge 11*a* of the lower run of the split belt 11 is from about 1 to 2 m. The distance is maintained constant via relative location sensor means 18 located at suitable positions on each side of the compactor 10 and paver 22. The relative location sensor means 18 on each side may comprise, for example, an infra-red or laser beam emitter supported on the spreader 24 so as to emit the beam transversely to the direction of advancement, towards a target supported on a forwardly projecting element 19 on the compactor 10. The target has a zero position and one or more plus and minus positions on respective sides of the zero position. The preset speed of rotation of the respective drum 12 and belt 11 is maintained while the beam hits the zero position of the target, but the speed will be temporarily increased or decreased if the beam hits a plus or minus position, respectively. Such sensor means are known but are advanced merely for illustrative purposes.

Typically, the paver 22 travels at a speed of about 0.1 m/s whilst laying the asphalt mat 20. It will be recognized that the speed of the compactor 10, therefore, will be substantially less than that conventionally used in asphalt compaction processes. Furthermore, as the compactor 10 follows immediately behind the paver 22, the temperature of the asphalt mat 20 is at or substantially at the spreading temperature as compaction begins. The heating of the belt 11 by the hot liquid in the drum 12 and reservoir 13, and the shroud 16, alleviate heat loss during compaction, so that the temperature of compaction may be 150° C. or more.

As shown in FIGS. 1 and 2, the width Y of the compactor 10 and belt 11 is 4 m and therefore such that the full width of the asphalt mat 20 laid by the spreader 24 is covered by the belt 11 on a single run of the compactor 10. The length of contact X defined by the lower run of the belt 11 is 3 m. For a compactor having a total mass of 24 tonne (240 kN) including the hot liquid in drum 12 and reservoir 13, a uniform contact stress of 20 kPa will be applied by the belt lower run. Assuming a speed of 0.1 m/s (typical for a placement rate of 1000 tonne per 6 hour day per paver, laying asphalt in a 50 mm thick layer), the load duration at any point on the asphalt mat beneath the compactor belt will be about 30 seconds. At this load duration and at 150° C., the binder stiffness will be about 0.05 Pa.

The above size of compactor will be used in large scale projects. In smaller scale projects the compactor 10 may have a much smaller "footprint", for example a length of contact X of 2 m and width of 2 m or 4 m. A smaller footprint will generally correspond with a reduced mass of the compactor 10 as a whole. If so, this may be offset by increasing the temperature of the process. In such a case, a steel-segment belt 11 may be used, heated by a direct flame.

Referring now to FIGS. 3 and 4, there is shown a modification to the compactor 10 of FIGS. 1 and 2 by which the compactor 10 is physically interconnected with the paver 22. The compactor 10 retains its own auxiliary drive for the drum 12, so that the speed of advancement of the compactor can be set to that of the paver. Thus, the mechanical interconnection between the paver and compactor is intended to provide only steerage to the compactor.

The mechanical interconnection is shown schematically as the frame 26 which projects forwardly from a leading end of the framework 17 of the compactor to the sides of the spreader 24 and inwardly to a hitch 28 beneath the paver. The hitch 28 may provide a rigid or pivotable interconnection between the paver and compactor at the large radius curves confronted by the apparatus.

In operation, as the paver turns, this will be sensed by the frame 26 which will mechanically impart the same turning motion to the compactor. A similar function may be achieved by replacing the frame 26 by, for example, a simple cable arrangement.

FIG. 4 illustrates the longitudinal split of the compactor, including the drums, rollers and belt, and it will be appreciated that the compactor may be made up of substantially identical modules, of for example 1 m width, which are secured side-by-side to make up the desired width of the compactor. If each of two belts in the compactor or each outer belt has its own power supply, the speed of rotation of these belts may be adjusted individually to facilitate the turning of the compactor. Any inner belt may not be powered.

FIGS. 5 and 6 better illustrate an alternative arrangement of the compactor for use generally in smaller scale projects. In FIGS. 3 and 4, the compactor 30 has substantially the same set-up as the compactor 10 shown in FIGS. 1 and 2 so will not be described in detail. The compactor 30 includes the large diameter rotary drum 32 having an auxiliary hydraulic drive, a hot liquid reservoir 34, the upper and lower transverse rollers 36 and 38 respectively, a framework 40 supporting the drum and rollers, a rotating belt 42 and a thermal insulation shroud 44. In this embodiment, however, rather than being maintained immediately behind the paver as in FIGS. 1 to 4, the compactor 30 is steered from behind by a conventional tractor 46 from an articulated roller compactor, the compactor being attached to the tractor by means of a pivot connection 48 at one end of the framework 40. As before, the belt 42 has a substantially rigid planar lower run but, for increased manoeuvrability, the lower run may have a reduced length of, for example, 2 m or less.

A single belt 42, whether elastomeric or non-elastomeric, may be used in this embodiment as steering is performed by the tractor 46 which has large diameter, liquid-filled smooth tires 50.

As with the compactor 10 of FIGS. 1 to 4, the hot liquid reservoirs 32 and 34 may be enhanced or replaced by a super heated air blower or direct flame heater for the belt. Such heating may be performed internally of the belt, for example on the upper run, or externally, for example between the shroud 44 and the drum 32 adjacent the lower run. Such heating of the belt may also be used to supply heat to the asphalt during compaction, in which case satisfactory compaction with viscous flow of the binder may be achieved even though the asphalt has been allowed to cool to a greater extent before compaction.

The compactor 30 includes an hydraulic jacking system 52 which is adapted to raise the belt 42 off the ground such that the belt is free to rotate whilst the compactor is stationary. This facilitates even heating of the belt prior to the start of a compaction run. The jacking system is carried by the framework 40 at the opposite end of the compactor to the pivot connection 48 and incorporates a wheel assembly 54 such that it may also be used to facilitate transportation and non-use manoeuvrability.

The compactor 30 may be used at speeds up to about 0.7 m/s, which even with a belt lower run length of, for example, 2 m will provide a compaction duration of about 3 seconds in a single pass, substantially more than the described prior art. However, the compactor 30 will preferably be used at speeds less than 0.7 m/s, for example about 0.5 m/s or less, thereby increasing the load duration in a single pass. The compactor 30 may be used in the manner described with reference to the compactor 10, that is immediately behind the paver and travelling substantially at the rate of the paver, but the compactor 30 will more usually be used independently of the paver at the higher speeds. Under these circumstances, the compactor 30 may readily have multiple passes over the asphalt mat to provide the desired degree of compaction. Each pass may be between the paver and upto, for example, 400 m from the paver, towards and away from the paver, and the speed of the compactor may be adjusted to enable the compactor to keep up with the rate of paving after the necessary number of passes. The compactor may apply a uniform load stress of 20 kPa.

Referring now to FIGS. 7 and 8, there is shown a compactor 60 which is intended to be used in exactly the same manner as the compactor 30 of FIGS. 5 and 6. However, the compactor 60 shows a modular form of belt compaction unit, two of which replace the dual steel drums in a known articulated dual drum compactor. The known compactor comprises a power and control module 64 and two drum modules which are partially illustrated by dashed lines 66 representing the drums.

Each compactor module 62 comprises a typical frame 68 having a hitch 70 at one end for pivotal connection to the power and control module 64 which sits between and above the compactor modules 62. The frame 68 in the known drum compactor has the drum 66 journalled within the frame. In place of this, a smaller upper drum 72 for an elastomeric or non-elastomeric belt 74 is journalled within the frame in the same manner. Beneath the drum 72, the frame 68 supports a lower roller assembly 76 for the belt. The roller assembly 76 comprises leading and trailing rollers 78 and 80, respectively, of smaller diameter than the drums 72, and an array of smaller intermediate rollers 82. The rollers 78, 80 and 82 define a planar lower run of the belt which defines the compaction surface of the compactor module 62. The lower run of the belt 74 in each compactor module preferably has a length of 1.5 to 2 m, but may be longer or shorter. As shown in FIG. 8, the belt width is about 2 m to correspond with the standard drum modules, but may be more or less.

The drum 72 in each compaction module 62 is driven in the same manner as the known drum 66 by the power and control module 64 through an auxiliary hydraulic drive (not shown). In addition to the connection together of the compaction module 62 through the power and control module 64, the compaction modules are connected by a steering hydraulic ram 84, or preferably two steering hydraulic rams, one on each side of the hitches 70. The hydraulic ram or rams 84 are controlled by a hydraulic valve assembly (not shown) receiving steering inputs from the driver of the compactor.

Each compaction module 62 has the belt 74 wholly enclosed except for the lower run beneath a shroud 86. The shroud helps to alleviate heat loss from the mat 88 during compaction, but advantageously also contain a hot environment for the belt. Such a hot environment may be provided by, for example, providing hot liquid in the drum 72, but preferably is provided by super heated air supplied to the enclosure beneath the shroud by a heater on the compaction module or, more preferably, on the power and control module 64. This heating of the belt helps to maintain a desired compaction temperature even though a particular portion of the mat 88 may have cooled below that temperature by the time the compactor 60 passes over it.

It will be noted in FIG. 7 that each compaction module 62 has a substantially lower axes of rotation of the drum 72 than is the case for the drum 66 in existing drum modules, leading to improved safety particularly on slopes.

It will also be appreciated that the compaction module 62 may readily replace the compactor 30 in FIGS. 5 and 6 as well as, with some modification, the compactor 10 in FIGS. 1 to 4.

In each of the described embodiments, the belt compactor advantageously includes means (not shown) for tensioning the belt. Such means may include a roller or drum which is hydraulically displaceable.

It has been found that advantageously the asphalt compaction methods and compactors according to the various aspects of the invention provide asphalt with significantly less permeability than asphalt compacted using conventional equipment and techniques. In this regard, tests were conducted in line with the New South Wales Road and Traffic Authority (RTA) Standard Test Method T168 (1990) entitled "Determination of Insitu Infiltration of Water into a Road Pavement". Briefly, according to this test method a viewing tube provided with height markings is positioned such that it extends vertically above the area to be tested. The viewing tube is supported at is base by a base plate. Water is introduced into the viewing tube and quickly brought to the desired height as marked on the tube. The water then flows through the base plate and into contact with the bitumen surface being tested. The rate of fall of the water level between upper and lower marks on the viewing tube is recorded and the porosity of the surface being tested calculated.

Using this method it was found that on testing asphalt prepared in accordance with aspects of the invention, the time taken for the head of water to drop from 1 m. to 900 mm was in the order of 10 to 20 seconds. When conventionally compacted asphalt was tested on the trial site, the flow rate of water into the pavement was such that a head of water of only 200 to 300 mm could be maintained. It is believed that the higher permeability of conventionally prepared asphalt surfaces may be due to roller cracking or non-closure of air voids and capillaries resulting from the conventional techniques.

Throughout this specification, unless the context requires otherwise, the word "comprise", or variations such as "comprises" or "comprising", will be understood to imply the inclusion of a stated integer or group of integers but not the exclusion of any other integer or group of integers.

Those skilled in the art will appreciate that the invention described herein is susceptible to variations and modifications other than those specifically described. It is to be understood that the invention includes all such variations and modifications which fall within its spirit and scope. The invention also includes all of the steps or features referred to or indicated in this specification, individually or collectively, and any and all combinations of any two or more of said steps or features. For example, the invention may extend to a belt compactor in which the belt is enclosed within the compactor substantially to the level of a lower run of the belt or to a belt compactor in which means is provided for heating the belt, as described. Alternatively, the invention may extend to any other feature or combination of features of the belt compactors described herein.

What is claimed is:

1. A method of compacting a mat of hot mix asphalt which has been laid by an advancing asphalt paver, the method comprising advancing an asphalt compactor over the laid asphalt such that a compaction surface of the compactor, formed by a lower run of at least one belt, is engaged with any one portion of the mat for a period of at least 1.5 seconds, the compaction surface applying a maximum average load stress to the mat of less than about 50 kPa, wherein the applied load stress increases gradually from the leading edge of the compaction surface to the trailing edge of the compaction surface.

2. A method according to claim 1, wherein the maximum line stress at the trailing edge of the compaction surface is about 40 kPa and the maximum average applied load stress is about 25 kPa.

3. A compactor comprising at least two longitudinally spaced modular compaction units connected relative to each other and a power source for driving at least one of the modular compaction units, wherein at least one of the modular compaction units is adjustable to permit steering of the compactor, and wherein each of said modular compaction units comprises a compaction belt and support means for the belt to define a planar lower run of the belt forming a compaction surface, and wherein in each modular compaction unit the belt extends between two large diameter drums or a single larger diameter drum at the leading end of the respective compaction unit, which is optionally driven, and two smaller drums or rollers respectively defining the upper and lower runs of the belt at the trailing end of the respective compaction unit.

4. A compactor according to claim 3 wherein the two modular compaction units are pivotally connected relative to each other.

5. A compactor according to claim 3 wherein the belt lower run in each of the modular compaction units is at least 1 m long.

6. A compactor according to claim 3 wherein in each modular compaction unit between the leading and trailing ends of the lower run the belt is supported or engaged to provide the desired constant or gradually increasing load stress to the surface of the material to be compacted.

7. A compactor according to claim 3 wherein each of the belts comprises elastomeric material, a series of pivotally interconnected rigid segments or is formed of mesh or woven wire.

8. A compactor according to claim 3 wherein each modular compaction unit is partially enclosed within the respective compaction unit, wherein the belt is enclosed in the planar lower run of the belt.

9. A compactor according to claim 8, wherein each belt is enclosed in part or wholly by a respective insulating shroud which optionally extends over the belt substantially to the level of the compaction surface.

10. A compactor according to claim 8, wherein each belt is partly enclosed by a respective support system for the belt.

11. A compactor according to claim 3, comprising heating means for heating each of the compactor belts.

12. A compactor according to claim 3 wherein a respective drum or roller associated with each compactor belt acts as a reservoir for hot liquid.

13. A compactor according to claim 3 wherein a hot liquid reservoir is provided between two drums or rollers associated with each of the compactor belts, or adjacent a single such drum or roller.

* * * * *